US005992989A

United States Patent [19]

Bainvel et al.

[11] Patent Number: 5,992,989

[45] Date of Patent: Nov. 30, 1999

[54] INK RESERVOIR INTEGRATED IN A FRANKING HEAD

[75] Inventors: Jean-Marc Bainvel, Boulogne Billancourt; Jean-Pierre Gregoire, Brie Comte Robert, both of France

[73] Assignee: Neopost Industrie, Bagneux, France

[21] Appl. No.: 08/781,623

[22] Filed: Jan. 9, 1997

[30] Foreign Application Priority Data

Jan. 10, 1996 [FR] France ..... 96 00198

[51] Int. Cl.[6] ..... B41J 2/175

[52] U.S. Cl. ..... 347/86

[58] Field of Search ..... 347/85–87; 222/40, 222/189.06, 189.09, 189.1, 255

[56] References Cited

U.S. PATENT DOCUMENTS

| | | | |
|---|---|---|---|
| 4,571,599 | 2/1986 | Rezanka | 347/87 |
| 4,760,409 | 7/1988 | Kiyohara et al. | 347/86 |
| 5,367,328 | 11/1994 | Erickson | 347/7 |
| 5,531,055 | 7/1996 | Sell et al. | 53/86 |
| 5,675,367 | 10/1997 | Scheffelin et al. | 347/86 |
| 5,686,948 | 11/1997 | Crystal et al. | 347/85 |

FOREIGN PATENT DOCUMENTS

| | | |
|---|---|---|
| 0510665A2 | 10/1992 | European Pat. Off. . |
| 0589540A1 | 3/1994 | European Pat. Off. . |
| 7926647 | 6/1980 | France . |
| 2709730A1 | 9/1978 | Germany . |

*Primary Examiner*—N. Le
*Assistant Examiner*—Michael Nghiem
*Attorney, Agent, or Firm*—Sughrue, Mion, Zinn, Macpeak & Seas, PLLC

[57] ABSTRACT

An ink reservoir for feeding a print module of a print head of a postage meter, the reservoir being integrated in said print head and including intermediate storage means for containing a determined main volume of ink having a central zone of symmetry S, means for bringing the ink to the intermediate storage means from an ink supply situated in a base of the postage meter, and suction means for taking ink from the intermediate storage means and feeding it to the print module, wherein the reservoir further comprises means for defining a free surface of the ink at a distance from said zone of symmetry, and wherein the suction means penetrates into the intermediate storage means in the vicinity of said central zone of symmetry in such a manner that the suction means remains continuously immersed in the volume of ink whatever the inclination of the reservoir.

10 Claims, 5 Drawing Sheets

INK RESERVOIR INTEGRATED IN A FRANKING HEAD

TECHNICAL FIELD

The present invention relates solely to the field of processing mail and it concerns an ink reservoir for a print module integrated in a removable print head of a postage meter or "franking machine", and specifically adapted to transporting said head.

PRIOR ART

Acceptable operation of a postage meter print module, in particular an ink jet print module, assumes that there is no trace of air inside the ink feed duct of the module, both while in operation and while not in operation, and regardless of whether the print head is mounted on the base of the postage meter.

OBJECT AND DEFINITION OF THE INVENTION

An object of the invention is to provide an ink reservoir capable of being handled and transported without presenting the above-mentioned drawbacks. Another object is to propose a reservoir structure that is relatively simple and capable of being integrated easily in a print head.

These objects are achieved by an ink reservoir for feeding a print module of a print head of a postage meter, the reservoir being integrated in said print head and including intermediate storage means for containing a determined main volume of ink having a central zone of symmetry S, means for bringing the ink to the intermediate storage means from an ink supply situated in a base of the postage meter, and suction means for taking ink from the intermediate storage means and feeding it to the print module, wherein the reservoir further comprises means for defining a free surface of the ink at a distance from said zone of symmetry, and wherein the suction means penetrates into the intermediate storage means in the vicinity of said central zone of symmetry in such a manner that the suction means remains continuously immersed in the volume of ink whatever the inclination of the reservoir.

In this structure, it is possible to handle and transport the reservoir without any risk of the print module being made unusable for printing monetary values due to the presence of bubbles of air in the ink. The intermediate storage means is constantly filled to a minimum level and the ink suction zone which is situated as close as possible to a central zone of symmetry of said storage means can remain immersed whatever the inclination of the reservoir.

The means for defining the free surface of the ink may be constituted by an overflow duct that pours excess ink brought from the supply into an overflow cavity of the reservoir, or merely by means designed at all times to ensure a minimum level of ink in the independent storage means, independently of the ink taken by the print module.

The integrated ink reservoir of the invention further includes a duct for connection to the atmosphere to maintain the intermediate storage means selectively at atmospheric pressure.

Preferably, the intermediate storage means is generally cylindrical in shape with two opposite and non-touching reentrant portions disposed on the axis of symmetry thereof and defining between them said central zone of symmetry. One of said reentrant portions includes the suction means. Advantageously, the reentrant portions include frustoconical or spherical external shapes to avoid catching microbubbles of air.

The suction means may be closed selectively by a shutter device, preferably a disk device, thereby making it: possible to guarantee that ink feed is cut off optimally. It further includes a strainer to prevent any foreign bodies being sucked into the print module.

The present invention also relates to any postage meter print head including an integrated ink reservoir as described above.

BRIEF DESCRIPTION OF THE DRAWINGS

Other characteristics and advantages of the present invention appear more clearly from the following description given by way of non-limiting indication and made with reference to the accompanying drawings, in which.

DETAILED DESCRIPTION OF A PREFERRED EMBODIMENT

Figure 1:
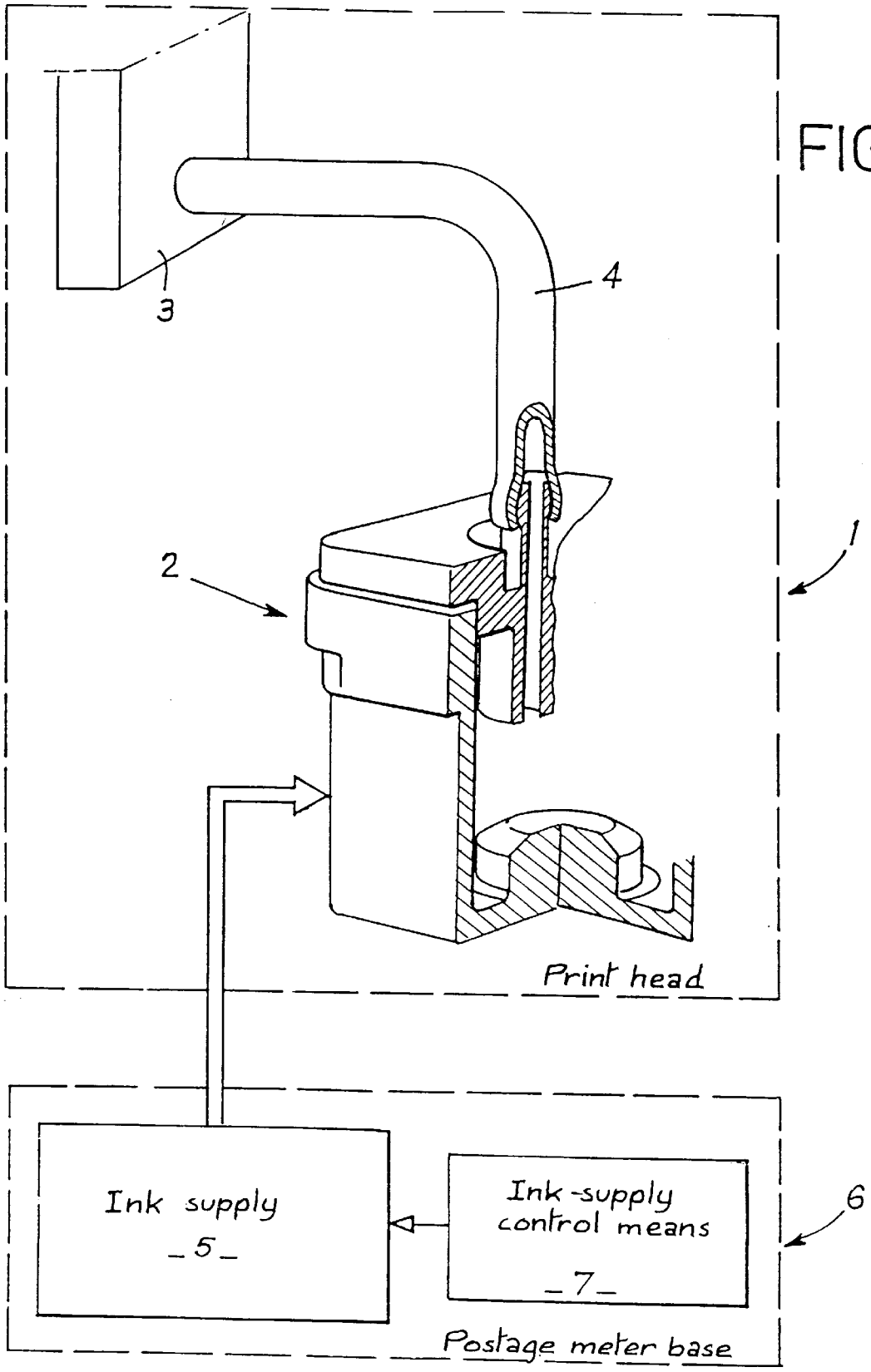
FIG. 1 is a diagrammatic view of an ink reservoir of the invention associated with an ink jet print module.

FIG. 1 shows a portion of a removable ink jet print head 1 of a postage meter incorporating an ink reservoir 2 of the invention together with a print module 3 connected to the reservoir by an ink feed hose 4. The reservoir is itself fed from an ink supply 5 situated in the base 6 of the postage meter and from which ink can be pumped continuously or on demand by control means 7.

The structure of the reservoir is shown in greater detail in FIGS. 2 to 5 which show the reservoir in perspective in various different orientations and with various portions cut away to show its internal structure.

The ink reservoir 2 essentially comprises a vessel 10 forming intermediate ink storage means between the supply and the print module, containing a determined main ink volume 12 and closed by a cover 14. Means formed by a feed duct 16 for bringing ink from the supply and suction means formed by an outlet duct 18 on which the hose 4 is fixed for feeding the print module are connected to this vessel (there may be one or more hoses depending on the number of nozzles to be fed). The outlet hose is provided at its inlet with a wall that is pierced with holes, such as a strainer 20, so as to prevent foreign bodies being sucked towards the ejection nozzles. An overflow duct 22 is also provided to pour excess ink into an overflow cavity 24. The residual volume of the vessel above the level of ink is maintained at atmospheric pressure by a duct 26 connected to the atmosphere. Each of the above-mentioned ducts is provided with a closure device: a device 28 for closing the inlet duct; a device 30 for closing the outlet hose; a device 32 for closing the overflow duct; and a device 34 for closing the duct that connects to the atmosphere. Naturally, each of these closure devices is controlled by a specific control mechanism, e.g. the mechanism 36 for controlling closure of the closure device of the hose for feeding the print module. To simplify the drawings, the other closure mechanisms are not shown, but the person skilled in the art will easily be able to design means enabling them to be implemented.

Figure 3:
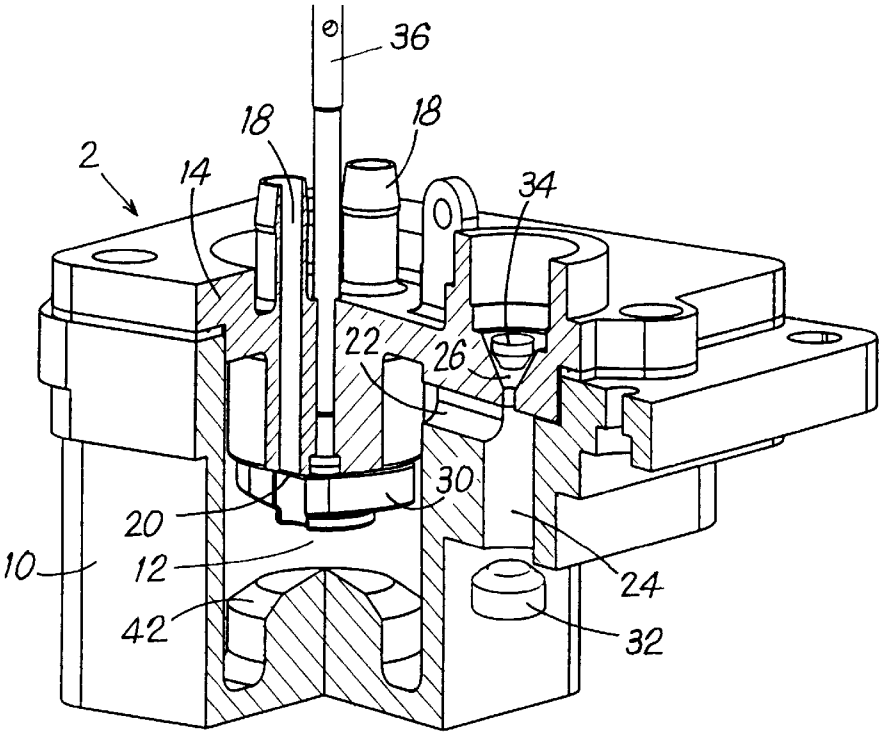
FIGS. 2, 3, and 4 are perspective views in three different orientations of the FIG. 1 reservoir, with various portions cut away.
Figure 2:
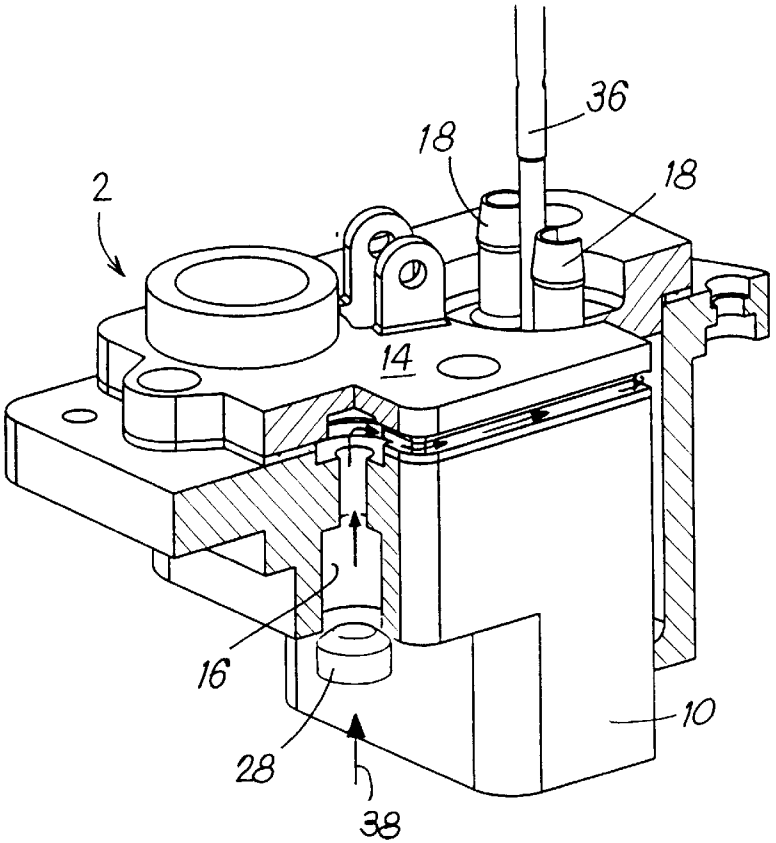
Figure 5:
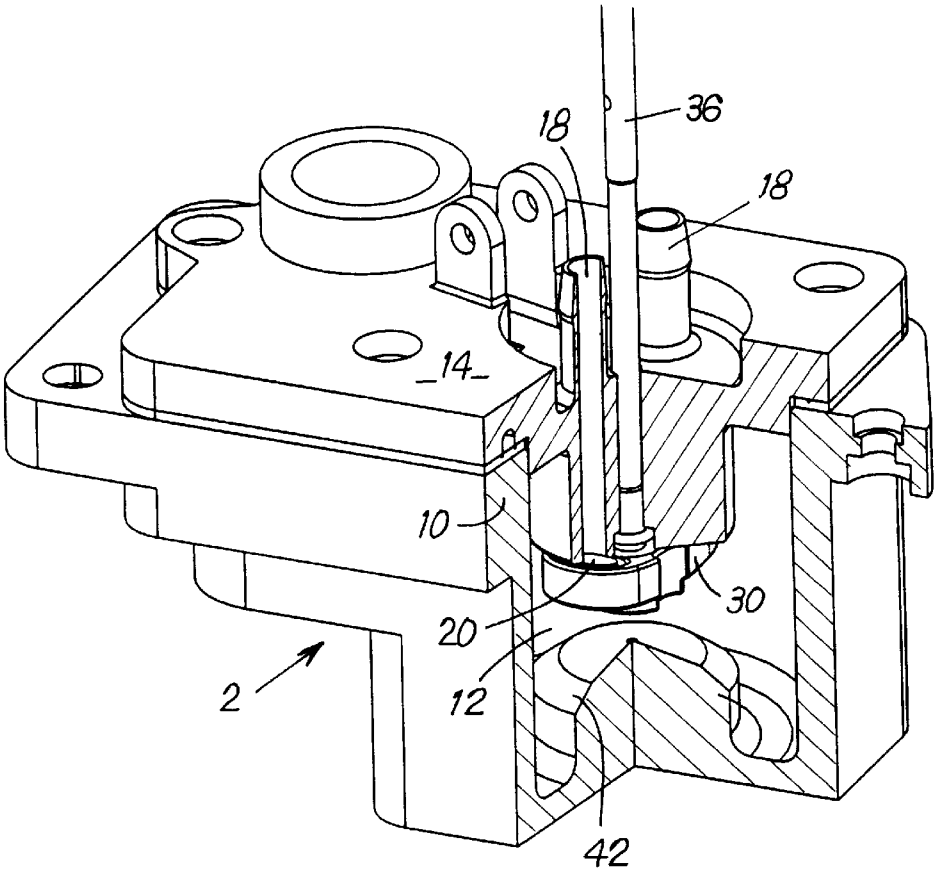
FIG. 5 is a perspective view of the reservoir with its feed duct closed.
Figure 4:
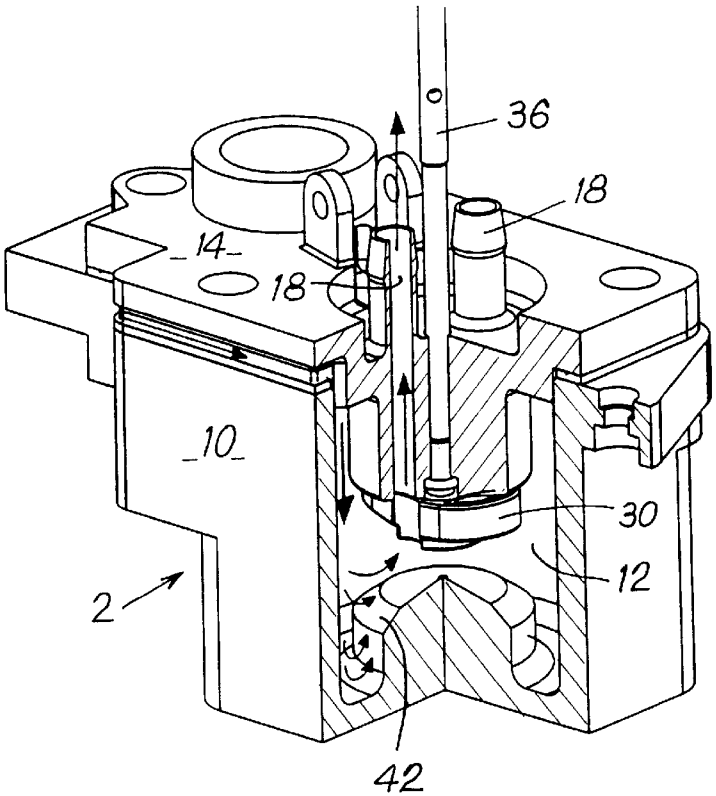
Figure 7:
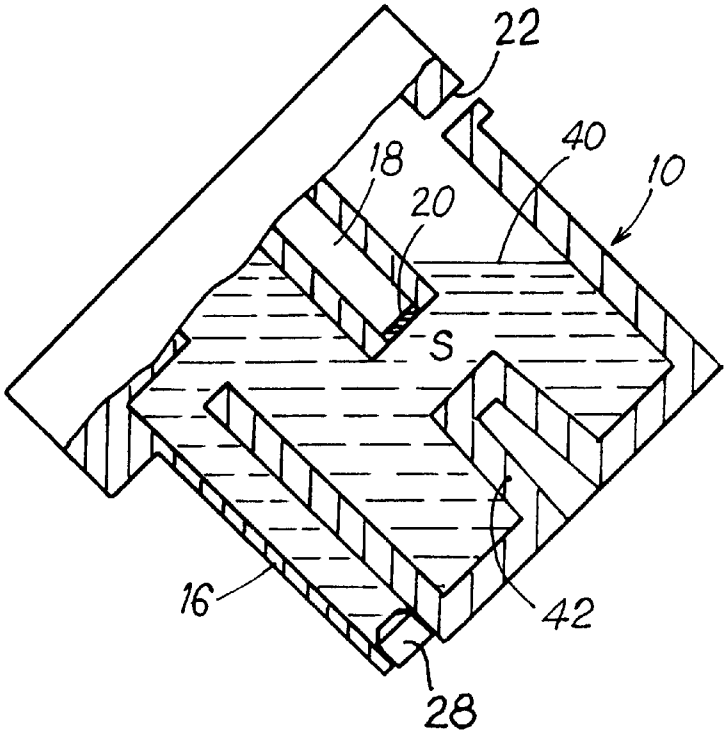
FIGS. 6, 7, 8, and 9 are diagrams showing the reservoir inclined at four different angles.
Figure 6:
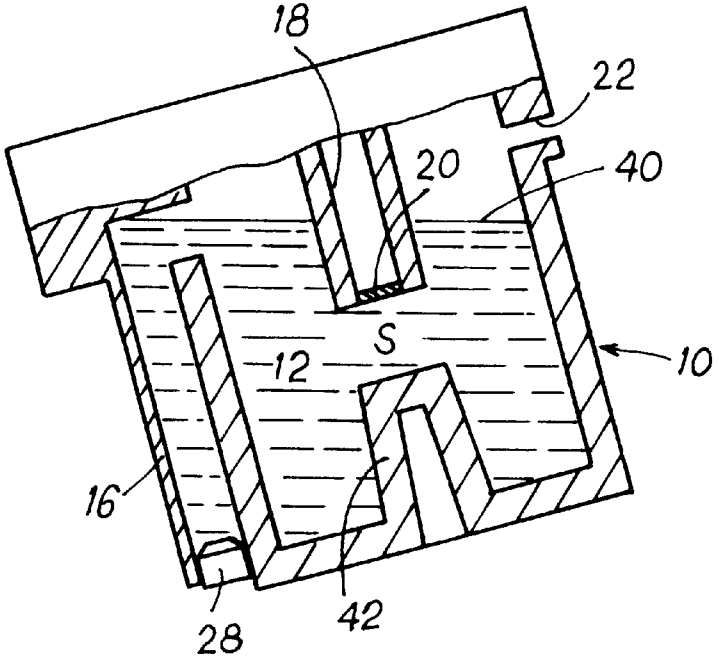
Figure 9:
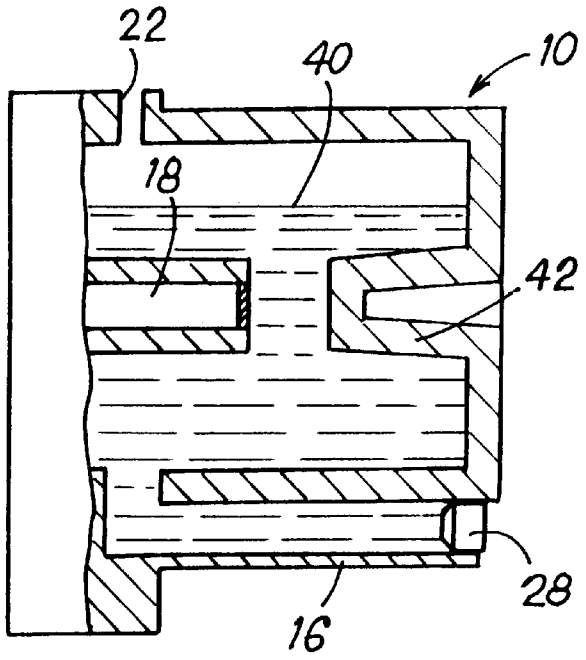
Figure 8:
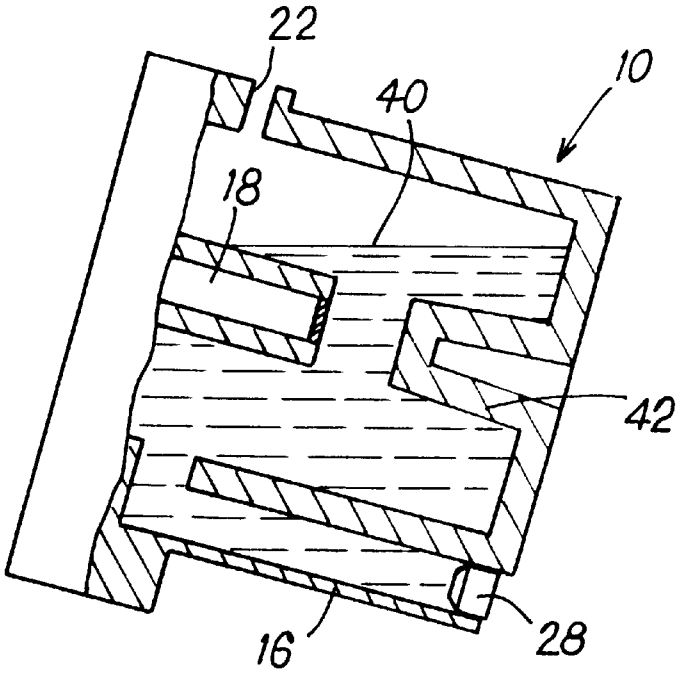

FIGS. 3 and 5 show two positions of the closure device 26 for the feed duct 18. This device must provide optimal cutoff of ink feed to the print module and it is preferably constituted by a disk shutter.

The open or closed positions of the closure devices that vary depending on whether or not the print head is mounted in the base of the postage meter, cause the reservoir to operate in different manners. When the head 1 is in place on the base 6, and in its mode for ejecting ink via the nozzles, the ink 38 is pumped from the supply 5 by the control means 7, and it reaches the vessel 10 of the reservoir 2 via the feed duct 16 whose closure device 28 is in the open state. It floods the internal volume 12 of said vessel until it reaches a level corresponding to the overflow duct 22, the closure device 32 for said duct then being in an open state (it will be observed that it is also possible to define a minimum level of ink within the vessel by means of the feed duct and overflow cavity assembly by appropriate control of the control means 7). The closure device 34 for closing the duct for connection to the atmosphere is also in an open state so as to keep the vessel at atmospheric pressure. Since the closure device 30 is naturally open, ink can then be sucked through the outlet duct 18 so as to be delivered to the various ejection nozzles. When not in said ejection mode, the various closure devices are closed by their respective control mechanisms, with the control mechanism 36 for the outlet duct 18 nevertheless being engaged before the others.

While the print head is being transported, after being removed from the base of the postage meter, the configuration of the vessel is such that the strainer 20 at the inlet to the outlet duct 18 for feeding ink to the print module remains continuously immersed, whatever the position of the head during such transport. FIGS. 6 to 9 show the reservoir in four different inclinations, respectively at 15°, 45°, 75°, and 90° relative to an initial vertical position, and they show clearly the essential feature of the invention. It can thus be observed that the free surface of the ink 40 lies continuously above the ink suction zone which is situated as close as possible to a central zone of symmetry of the main volume of ink 12. To do this, the vessel includes an end wall that is dome-shaped or that is in the shape of the bottom of a bottle (or "punt") 42, and the outlet duct 18 penetrates into said vessel over a distance that is sufficient to come into the vicinity of the central zone of symmetry facing the top of the dome. In addition, the overflow duct 22 which defines the free surface of the ink is placed far enough above said central zone.

Advantageously, the closure device 30 and the dome have frustoconical or spherical outside shapes so as avoid any possibility of catching microbubbles of air.

We claim:

1. An integrated ink reservoir for feeding a print module of a print head of a postage meter, the reservoir being integrated in said print head and including intermediate storage containing a predetermined main volume of ink having a central zone for symmetry S, a first conduit communicating the intermediate storage with an ink supply situated in a base of the postage mete, and a second conduit communicating the intermediate storage with the print module wherein said second conduit has a first end and a second end and, wherein the reservoir further comprises means for defining a free surface of the ink at a distance from said zone of symmetry and wherein the second end of said second conduit penetrates into the intermediate storage proximate to said central zone of symmetry in such a manner that said second end of said second conduit remains continuously immersed in the volume of ink irrespective of the inclination of the reservoir.

2. An integrated ink reservoir according to claim 1, wherein said reservoir has an overflow cavity and wherein said means for defining the free surface of the ink includes an overflow duct that conveys excess ink feed from the reservoir to said overflow cavity.

3. An integrated ink reservoir according to claim 1, wherein said means for defining the free surface of the ink includes means for main a minimum level of ink within the intermediate storage means independently of the ink taken by the print module.

4. An integrated ink reservoir according to claim 1, further including a duct communicating the intermediate storage with atmosphere to selectively maintain the intermediate storage at atmospheric pressure.

5. An integrated ink reservoir according to claim 1, wherein said intermediate storage is generally cylindrical in shape and has two opposite and non-touching reentrant portions disposed on the axis of revolution of said intermediate storage, defining between them said central zone of symmetry.

6. An integrated ink reservoir according to claim 5, wherein one of said reentrant portions includes the second conduit.

7. An integrated ink reservoir according to claim 5, wherein said reentrant portions having spherical or frustoconical shapes.

8. An integrated ink reservoir according to claim 1, further comprising a shatter device for selectively closing said second conduit.

9. An integrated ink reservoir according to claim 1, further comprising a strainer at an end of said second conduit for preventing any foreign bodies being sucked towards the print module.

10. A print head for a postage meter, said postage meter having an ink supply situated in its base, including an integrated ink reservoir for feeding a print module of a print head of a postage meter, the reservoir being integrated in said print head and including intermediate storage containing a predetermined main volume of ink having a central zone for symmetry S, a first conduit communicating the intermediate storage with said ink supply and a second conduit communicating the intermediate storage with the print module, wherein the reservoir further comprises means for defining a free surface of the ink at a distance from said zone of symmetry and wherein the second conduit penetrates into the intermediate storage proximate to said central zone of symmetry in such a manner that the second conduit remains continuously immersed in the volume of ink irrespective of the inclination of the reservoir.

* * * * *